US006833066B2

(12) United States Patent
Baumann et al.

(10) Patent No.: US 6,833,066 B2
(45) Date of Patent: Dec. 21, 2004

(54) LIQUID FILTER, ESPECIALLY OIL FILTER

(75) Inventors: Peter Baumann, Stuttgart (DE); Thomas Brieden, Waiblingen (DE); Hans Gebert, Heilbronn (DE); Markus Layer, Korb (DE)

(73) Assignee: Mahle Filtersysteme GmbH, Stuttgart (DE)

( * ) Notice: Subject to any disclaimer, the term of this patent is extended or adjusted under 35 U.S.C. 154(b) by 17 days.

(21) Appl. No.: 10/221,532

(22) PCT Filed: Jan. 27, 2001

(86) PCT No.: PCT/DE01/00351

§ 371 (c)(1),
(2), (4) Date: Sep. 13, 2002

(87) PCT Pub. No.: WO01/69050

PCT Pub. Date: Sep. 20, 2001

(65) Prior Publication Data

US 2003/0019462 A1 Jan. 30, 2003

(30) Foreign Application Priority Data

Mar. 15, 2000 (DE) ..... 100 12 461

(51) Int. Cl.[7] ..... B01D 35/153; B01D 35/157; B01D 35/18; B01D 35/30

(52) U.S. Cl. ..... 210/136; 210/137; 210/181; 210/184; 210/249; 210/428; 210/443

(58) Field of Search ..... 210/136, 137, 210/168, 181, 184, 440, 443, 249, 428, 435; 123/196 A; 184/6.24; 248/94

(56) References Cited

U.S. PATENT DOCUMENTS 2,602,547 A * 7/1952 Floss et al. ..... 210/133
2,646,886 A * 7/1953 Sprankl ..... 210/133
5,351,664 A 10/1994 Rotter et al.
6,379,537 B1 * 4/2002 Brieden et al. ..... 210/90

FOREIGN PATENT DOCUMENTS

| | | | |
|---|---|---|---|
| DE | 39 03 675 | 8/1990 | |
| DE | 42 42 997 | 4/1994 | |
| DE | 196 26 867 | 1/1998 | |
| DE | 197 41 449 | 3/1999 | |
| EP | 0 750 099 | 12/1996 | |
| EP | 0 816 645 | 1/1998 | |
| JP | 62093414 A * | 4/1987 | ..... 210/184 |
| WO | WO 99/39802 | 8/1999 | |

* cited by examiner

*Primary Examiner*—Matthew O. Savage
(74) *Attorney, Agent, or Firm*—Collard & Roe, P.C.

(57) ABSTRACT

The invention relates to a liquid filter, for example an oil filter for cleaning lubricating oil, especially for use in internal combustion engines of motor vehicles. A ring-shaped filter insert separates an unclean side from a clean side in the interior of the liquid filter. A metal filter housing comprises a first flange with which the liquid filter can be screwed to a component via a screw connection, said component having an inlet for uncleaned liquid, an outlet for cleaned liquid and a relatively pressureless idle duct. The first flange contains an axially acting outer seal that includes inlet, outlet and idle duct, and a carrier receiving compartment encircled by the outer seal. A functional carrier insert is inserted in the carrier receiving compartment and is provided with an inlet compartment open towards the inlet, an outlet compartment open towards the outlet, and a idle duct compartment open towards the idle duct, the individual compartments being sealed from one another by axially acting inner seals. The screw connection with which the first flange is screwed to the component acts in the axial direction and axially forces the axially acting seals against the component, while the functional carrier insert rests on the first flange.

18 Claims, 6 Drawing Sheets

LIQUID FILTER, ESPECIALLY OIL FILTER

CROSS REFERENCE TO RELATED APPLICATIONS

Figure 1:
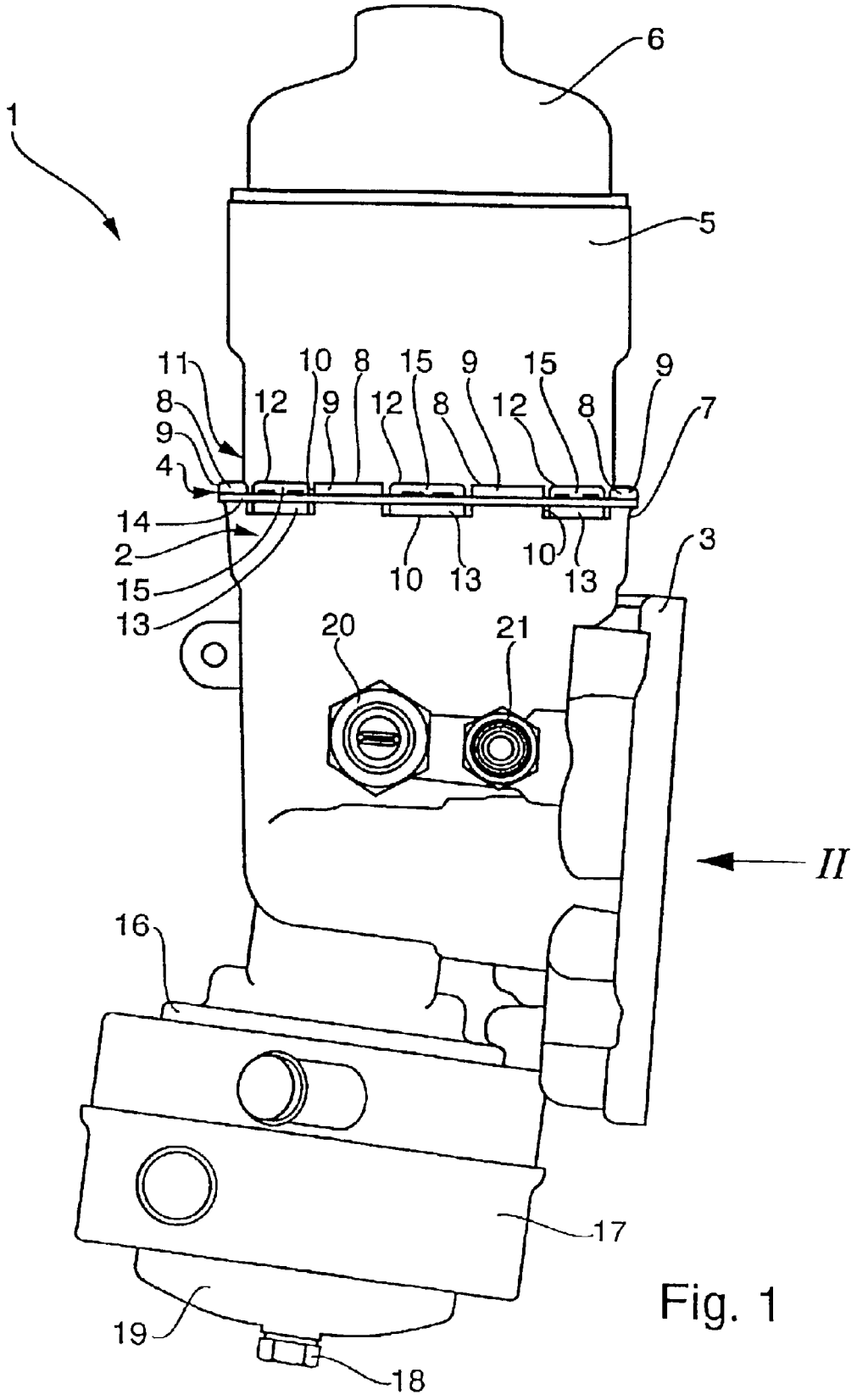

Applicants claim priority under 35 U.S.C. §119 of German Application No. 100 12 461.5 filed Mar. 15, 2000. Applicants also claim priority under 35 U.S.C. §365 of PCT/DE01/00351 filed Jan. 27, 2001. The international application under PCT article 21(2) was not published in English.

This invention relates to a liquid filter, in particular an oil filter, for cleaning lubricant oil, in particular for internal combustion engines in motor vehicles.

International Patent WO 99/39 802 describes a liquid filter which has a ring filter insert accommodated in a filter housing made of plastic, a feeder channel carrying crude liquid and a return channel which carries away the clean liquid. The feeder channel and the return channel are arranged in a collecting space of the filter housing, and this collecting space is bordered by a safety wall designed in one piece with the filter housing extending radially around the feeder channel and the return channel. The filter housing must be mounted securely on a component which has a feeder line for unpurified oil and an outlet for purified oil. The filter housing is usually mounted on the engine block of the engine. However, in the case of a sealed mounting of a filter housing made of plastic on this component, problems may arise because relatively high pressures prevail in the feed and in the outlet. Because of special installation conditions, it may occasionally be necessary to seal the filter housing with respect to the engine block by means of gaskets which act axially. In the case of a filter housing made of plastic, there is then the disadvantage that the contact forces required, with which the filter housing is clamped against the engine block, cannot be introduced into the plastic housing.

German Patent 39 03 675 C2 describes an oil filter whose filter housing contains a filter receiving space in an upper section to accommodate a ring filter insert and in a lower section it has a feeder channel for unpurified oil and an outlet channel for purified oil. The filter housing having the channels integrated into it is usually made of metal as a one-piece injection-molded component. In this way the required prestressing forces and contact pressure forces can be introduced into the metal housing to achieve a sufficient sealing effect with gaskets that act axially. However, in order to form smooth surfaces for gaskets, e.g., for the internal channels in the interior of the injection-molded housing produced in this way, immediate remachining of the injection-molded component is necessary. In machining the metal housing, cavities may be encountered due to porosity and shrink holes, necessitating a complicated remachining of the component.

The present invention is concerned with the problem of providing a design for a liquid filter of the type defined in the preamble that will allow the use of gaskets that act axially and can also be manufactured relatively inexpensively.

This problem is solved according to this invention by a filter having the features of claim 1.

This invention is based on the general idea that at least one part of the components of the filter housing, which are manufactured in one piece with the filter housing in the case of a traditional filter housing and must be remachined to fulfill their function, is combined in a function carrier insert that can be manufactured separately, and the axial seal with respect to the component on which the filter housing is to be mounted tightly is implemented by a screw connection of the filter housing onto the component. This yields on the one hand the possibility of an external remachining of these function elements, while on the other hand the function carrier insert may also be manufactured in such a way that remachining may be omitted. For example, the function carrier insert is made of plastic, in particular by an injection molding process. The surface quality produced in this way is of a sufficiently high grade so that remachining can usually be omitted. In addition, the filter housing made of metal has sufficient strength to produce a sufficient axial clamping effect, which in turn produces a sufficient axial pressing force for the axial gaskets. On the whole, this yields a liquid filter that can be manufactured especially economically.

Other important features and advantages of the device according to this invention are derived from the subclaims, the drawings and the respective description of the figures on the basis of the drawings.

It is self-evident that the features mentioned above and those to be explained below can be used not only in the respective combination indicated but also in other combinations, or they may be used alone without going beyond the scope of the present invention.

A preferred embodiment of this invention is illustrated in the drawings and explained in greater detail in the following description.

Figure 2:
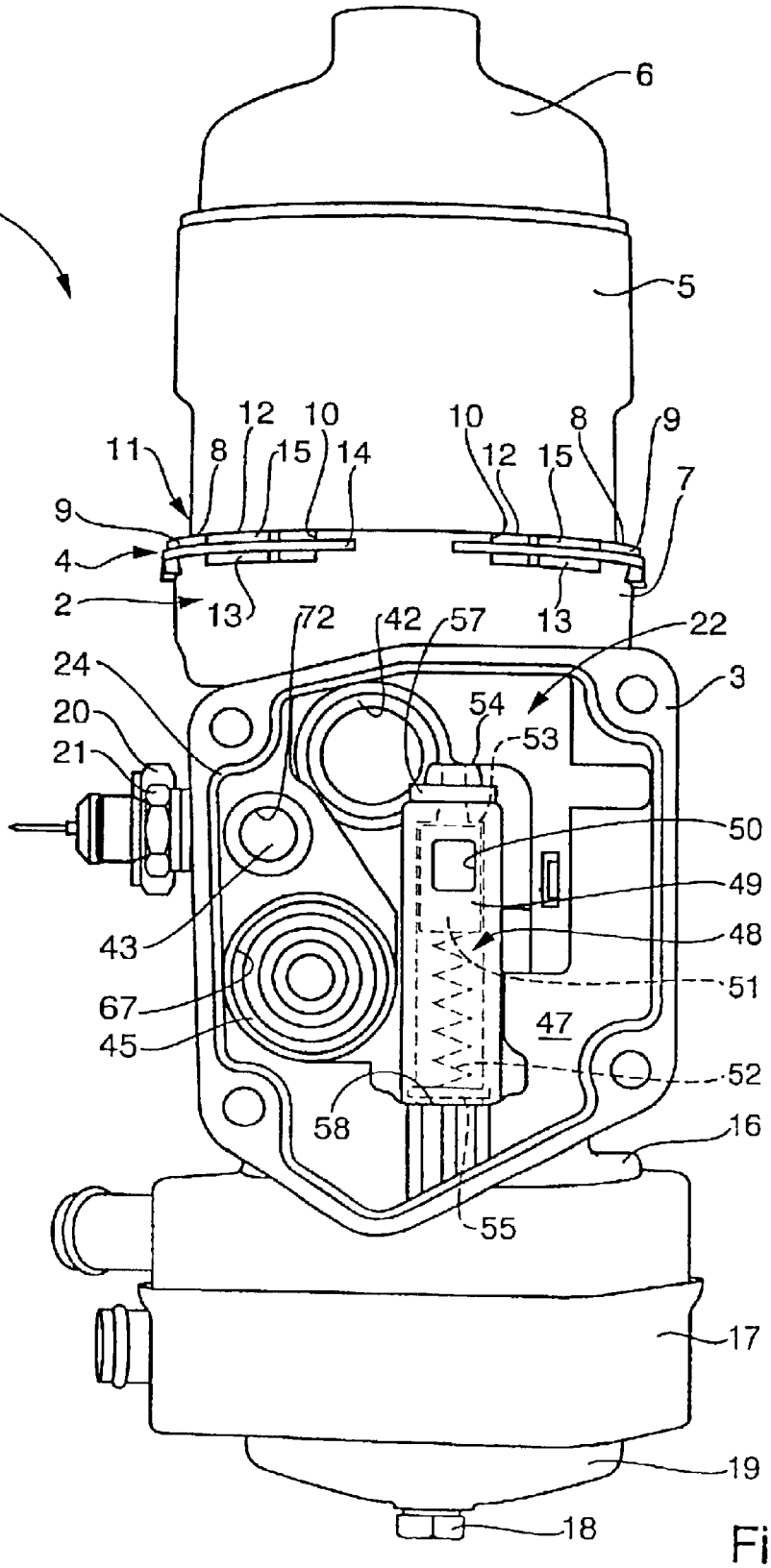
Figure 3:
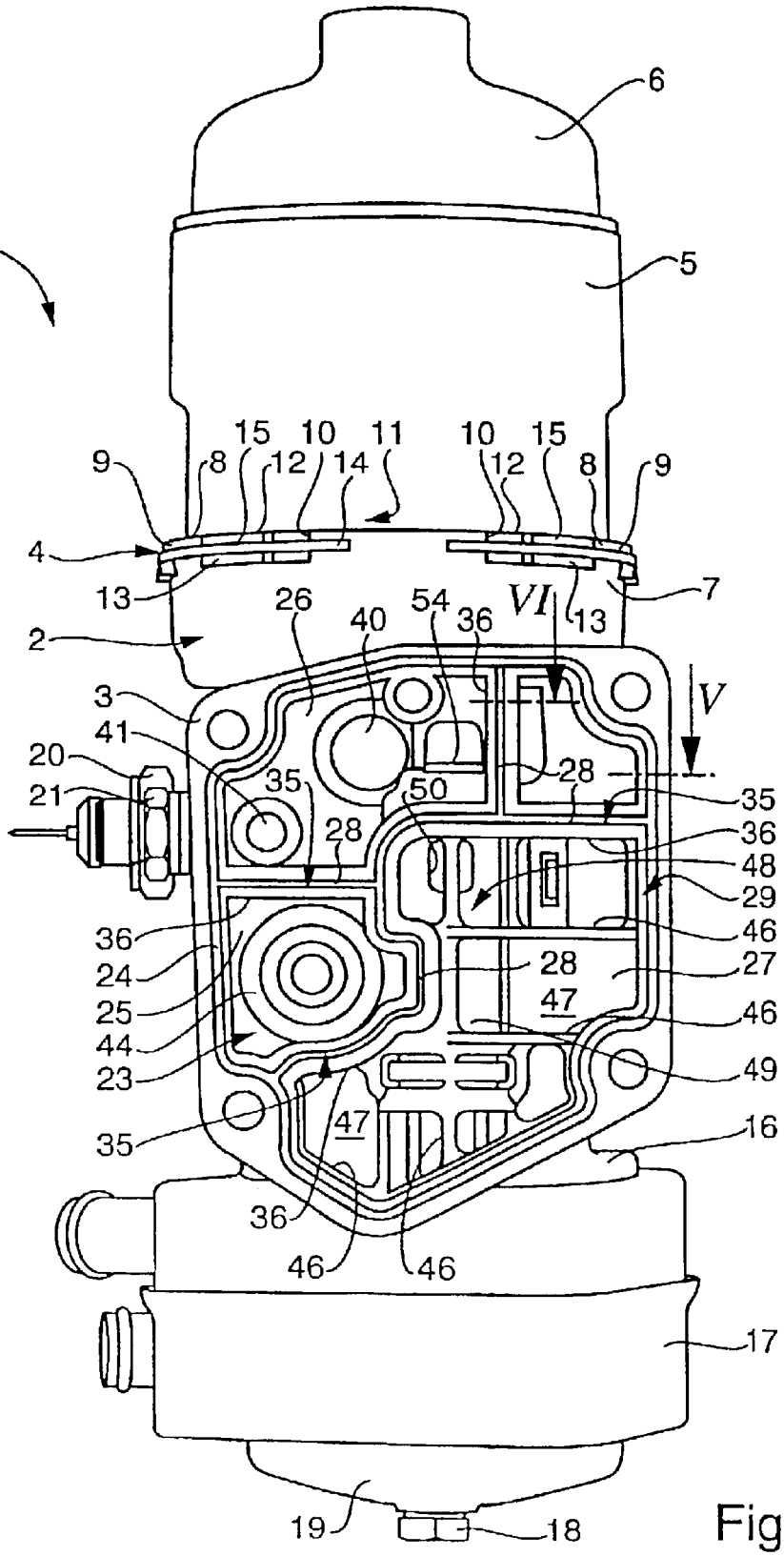
Figure 4:
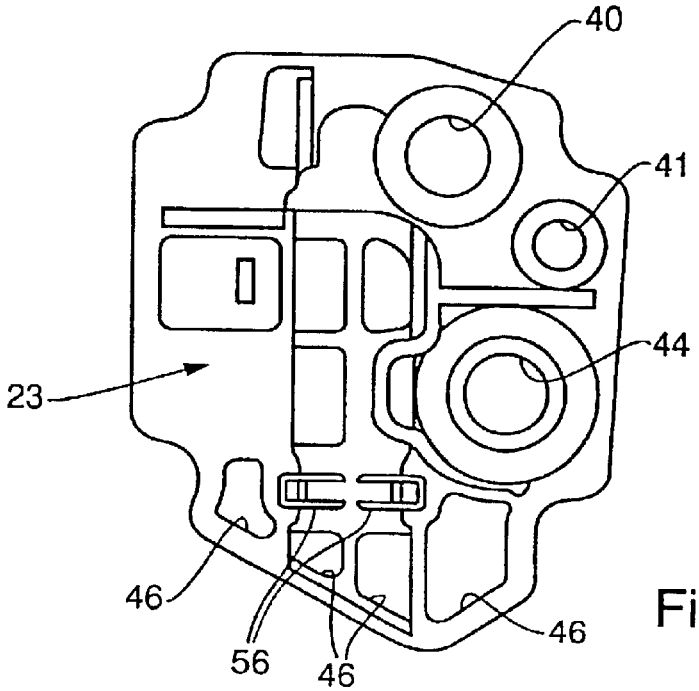
Figure 5:
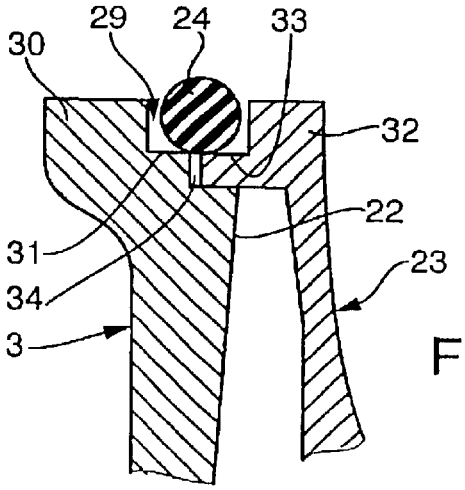
Figure 6:
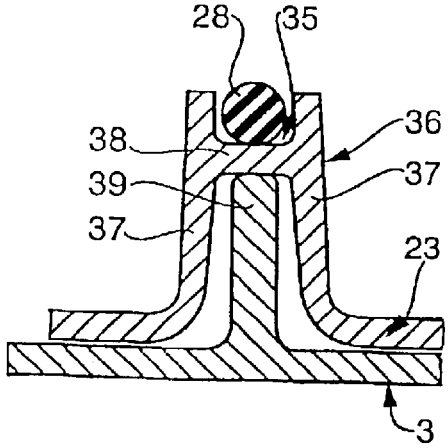
Figure 7:
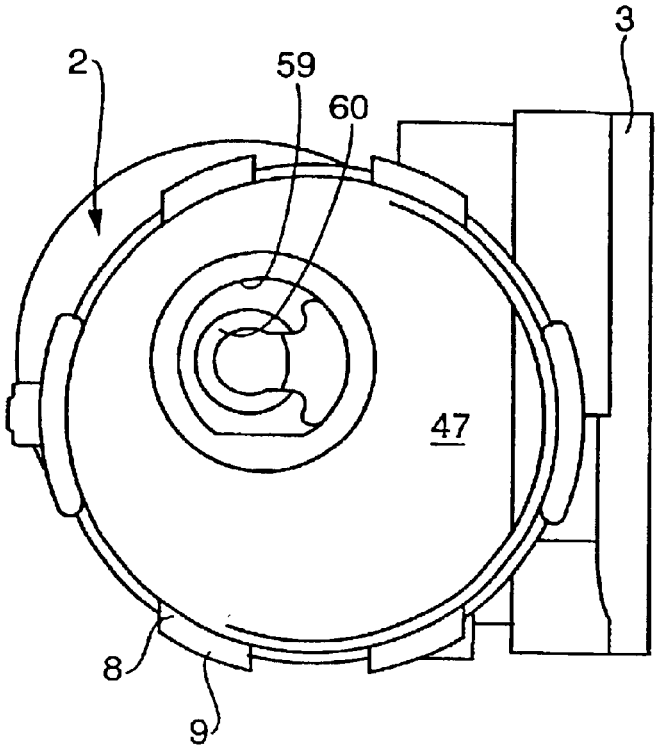
Figure 8:
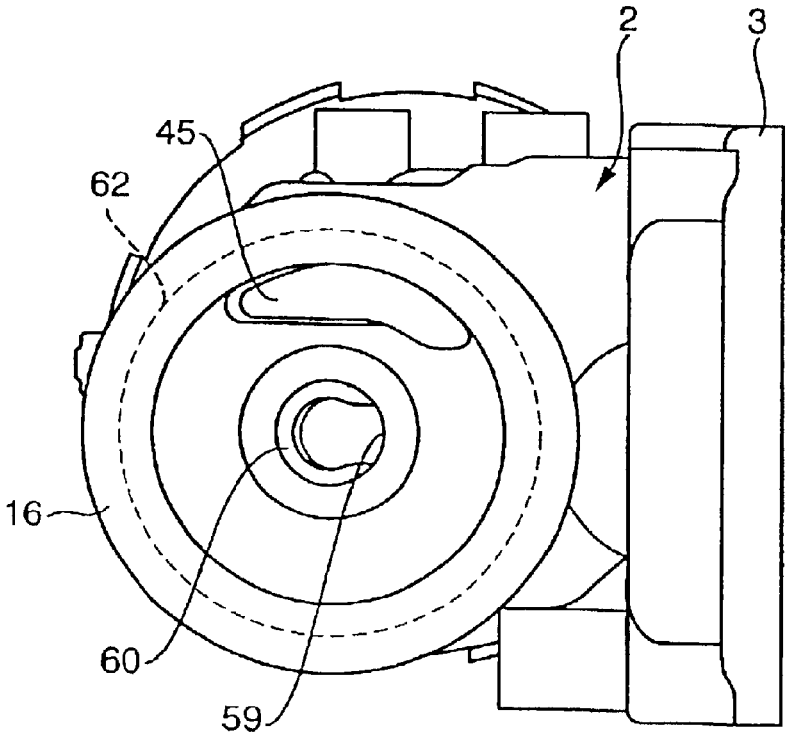
Figure 9:
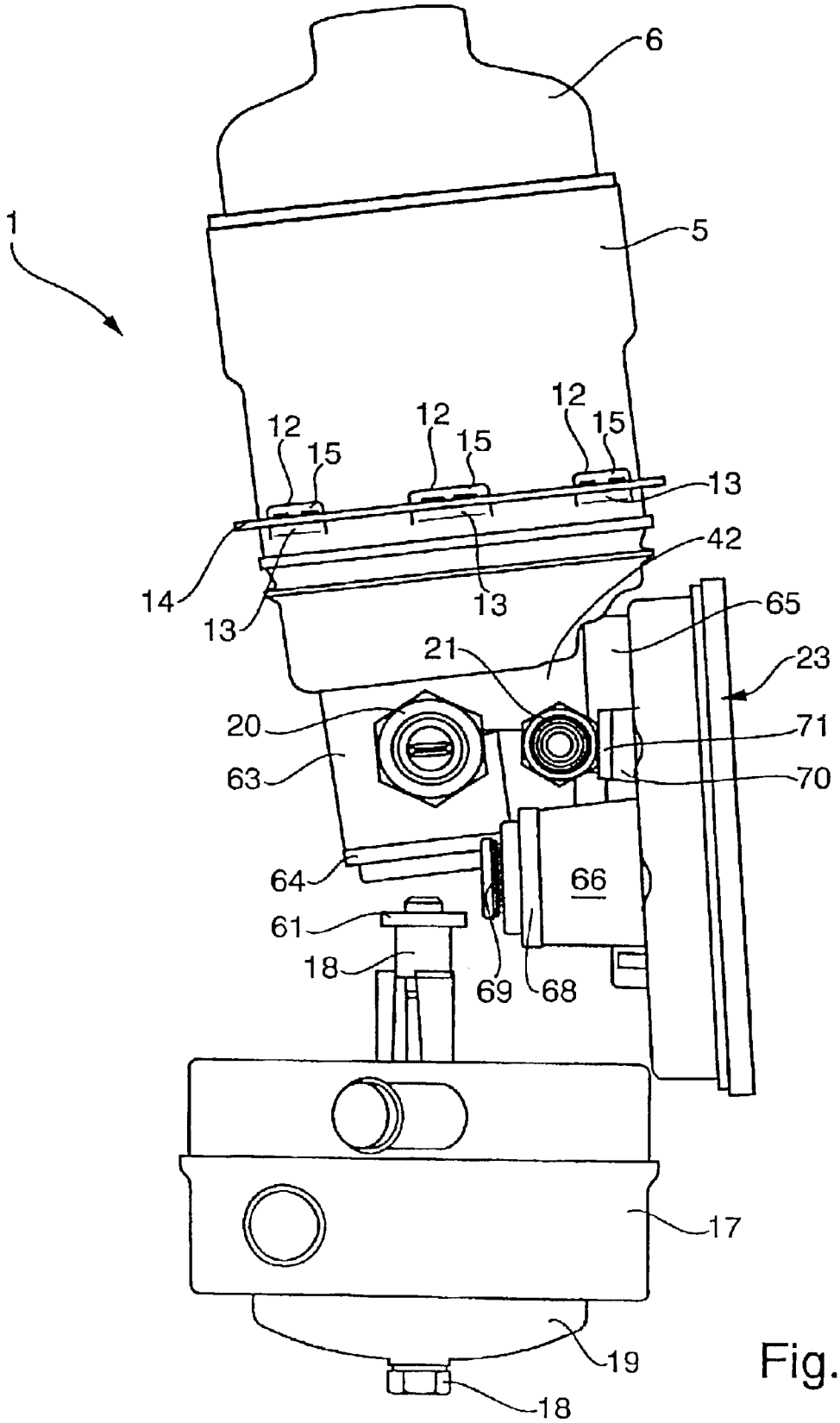

The drawings show schematically:

FIG. 1 a side view of a liquid filter according to this invention in an assembled state, FIG. 2 a view according to an arrow II in FIG. 1 of the liquid filter according to FIG. 1 without the function carrier insert, FIG. 3 a view like that in FIG. 2 but with the function carrier insert, FIG. 4 a rear view of the function carrier insert according to FIG. 3, FIG. 5 a detailed sectional view according to a sectional line V in FIG. 3, FIG. 6 a detailed view according to a sectional line VI in FIG. 3, FIG. 7 a view from above of a filter housing of the liquid filter from FIG. 1, FIG. 8 a view from beneath of the filter housing according to FIG. 7 and FIG. 9 a side view like that in FIG. 1 but without the filter housing according to FIG. 7.

According to FIG. 1, a liquid filter 1, which is designed here as an oil filter for cleaning lubricant oil used in the combustion engine of a motor vehicle, has a filter housing 2. The filter housing 2 is made of metal, especially lightweight metal such as cast aluminum or die-cast aluminum. A first flange 3 with which the liquid filter 1 can be screwed onto a component (not shown), e.g., the engine block of a motor vehicle, is provided on the right side of the filter housing 2 according to FIG. 1. On its upper side, filter housing 2 has a second flange 4 with which a filter chamber shoulder 5 is mounted on the filter housing 2. This filter chamber shoulder 5 is sealed with a cover 6 on its upper side, which faces away from the filter housing 2. A ring filter insert (not shown here) which separates a clean side from a crude side in the interior of the liquid filter 1 is situated in the interior of the filter chamber shoulder 5. The filter chamber shoulder 5 is made of a plastic here, e.g., as an injection-molded component. Cover 6 may also be made of a plastic.

The filter chamber shoulder 5 is secured on the filter housing 2 in a special way: the second flange 4 is designed to be essentially cylindrical—as is also the filter chamber shoulder 5—and it has a cylindrical wall 7 which projects axially away from the filter housing 2. Axial projections 8 are provided on this wall 7, having elevations 9 that project radially outward on their axial free ends. In FIG. 1 these elevations 9 project away from the filter housing 2 toward the observer of FIG. 1 in the case of the two center projections 8. Gaps 10 are formed between adjacent projections 8.

Radial projections 12 are provided on a cylindrical section 11 of the filter chamber shoulder 5 which cooperates with the second flange 4, these radial projections engaging in one of the aforementioned gaps 10 between the projections 8 of the filter housing 2. Projections 12 of the filter chamber shoulder 5 have elevations 13 which project outward radially on their lower side facing filter housing 2 according to FIG. 1.

In addition, a ring-shaped tension element 14 is also provided, encompassing the second flange 4 in the area of projections 8 and 12, so that then the elevations 9 extend over the projections 8 of the filter housing 2 reach over the tension element 14 from above radially, while the elevations 13 of the projections 12 of the filter chamber shoulder 5 reach over the tension element 14 from beneath radially. This yields an effective means of securing and fastening the filter chamber shoulder 5 on the filter housing 2.

In the present embodiment, an additional elevation 15 is also formed on the projections 12 of the filter chamber shoulder 5, likewise projecting radially outward away from the projections 12 and being arranged at the level of the elevations 9 of the projections 8 of the filter housing 2. This yields an additional means of attaching tension element 14 to the second flange 4. Tension element 14 consists of an open spring steel ring, for example.

Filter housing 2 also has a third flange 16 on its lower side by means of which a heat exchanger 17 or "cooler" is connected to filter housing 2. In the embodiment shown here, this heat exchanger 17 is the so-called doughnut type and has a central passage (not visible here) and is screwed onto filter housing 2 by means of a central fastening screw 18, with a cover 19 tightly sealing the central opening of heat exchanger 17.

On the side facing the observer, filter housing 2 may also be equipped with a first sensor 20, e.g., a temperature sensor and with a second sensor 21, e.g., a pressure sensor, to which end corresponding sensor terminals are provided on filter housing 2.

According to FIG. 2, a carrier receiving space 22 into which a function carrier insert 23 can be inserted according to FIG. 3 is provided in the interior of the first flange 3. The first flange 3 is equipped with an exterior gasket 24 which acts axially and encompasses the carrier receiving space 22 and thus the function carrier insert 23 inserted into it.

The function carrier insert 23 has a feeder space 25 which communicates with a feed for uncleaned liquid, this feed being arranged on the component which is not shown here and to which the liquid filter 1 is attached. In addition, the function carrier insert 23 has an outlet space 26 which communicates with an outlet for purified liquid in the aforementioned component. In addition, the function carrier insert 23 has a no-load space 27 which communicates with an idle of the component. Such a no-load space in a component formed by the engine block of an internal combustion engine usually leads to the oil pan, so the no-load space is relatively pressureless.

The individual spaces 25, 26, 27 are sealed with respect to each other with interior gaskets 28 which act axially. Gaskets 24 and 28 may be formed as individual elements, but an embodiment in which the exterior gasket 24 and the interior gaskets 28 are formed by a one-piece gasket body is preferred. The gaskets 24 and 28 are pressed axially against the component by the screw mounting of the first flange 3 on the component or engine block. It is clear that the function carrier insert 23 is adapted to the carrier receiving space 22 to this end, so that the function carrier insert 23 is supported on the inside on the first flange 3 or on the filter housing 2. The function carrier insert 23 here is made of plastic, e.g., as a single part produced by injection molding.

The prestress required to achieve an adequate sealing effect is achieved here by the screw connection on the first flange 3. This may be accomplished here with no problem because filter housing 2 is made of metal.

To accommodate the exterior gasket 24 a closed peripheral receiving groove 29 is formed in the first flange 3 so that the exterior gasket 24 can be inserted into it. According to FIG. 5, this receiving groove 29 may be designed in a preferred embodiment so that a peripheral inside step which has an L-shaped cross section and is open toward the function carrier insert 23 is provided on a wall 30 of the first flange 3. In addition, a peripheral outside step 33 having an L-shaped cross section (in mirror image) that is open toward the wall 30 of the first flange 3 is provided on an opposite wall 32 of the function carrier insert 23. The outside step 33 of the function carrier insert 23 and the inside step 31 of the first flange 3 supplement one another when function carrier insert 23 is inserted into the carrier receiving space 22 so as to be complementary to the receiving groove 29 which accommodates the outside gasket 24. Although this is a relatively complicated design, it permits an advantageous simplification in the manufacture of filter housing 2, because it minimizes the fine structures which result when groove 29 is situated exclusively in the flange 3 and which are relatively complicated to implement in production by metal casting. gasket 24 is arranged in the groove 29 so that an interface 34 formed between the function carrier insert 23 and the flange 3 is sealed. The dimensions of the wall 32 are preferably selected so that the wall 32 projects axially beyond wall 30. Due to this design, an axial prestress or bracing of the function carrier insert 23 is obtained when the first flange 3 is screwed onto the component.

According to FIG. 3, a groove 35 is also provided to accommodate the internal gaskets 28. This groove 35 or these grooves 35 are provided on the ends of partitions 36 which face the component and separate the individual spaces 25, 26, 27 in the function carrier insert 23 from one another. In a preferred embodiment, these partitions 36 are designed according to FIG. 6 as double walls, each having two essentially parallel individual walls 37. These individual walls 37 are joined at their free ends by a cross web 38 in whose front side facing the component is formed the groove 35 to receive the internal gasket 28. In the area of a partition 36 designed in this way, a rib 39 projecting toward the component away from the first flange 3 is formed on the first flange 3 or on the filter housing 2, in particular being integrally molded on it and engaging in the double wall, i.e., between the individual walls 37 and supporting the cross web 38 on its rear side facing away from the component. In this way an intense prestress can be applied to the internal gasket 28, and at the same time it reduces settling phenomena of the plastic of the function carrier insert 23.

According to FIG. 3, the outlet space 26 of the function carrier insert 23 has an outlet opening 40 which communicates with the clean side in the interior of the liquid filter 1. According to FIG. 2 a clean-side outlet connection 42 projects into the interior of the filter housing 2 which is formed on filter chamber shoulder 5. In addition, the outlet space 26 has another opening 41 which communicates with an auxiliary channel 43 which is formed in the filter housing 2 and is in turn connected to the sensor terminals of sensors 20 and 21.

The feeder space 25 of the function carrier insert 23 communicates via a feeder opening 44 (see FIG. 3) with a feeder channel 45 formed in the interior of filter housing 2 (see FIG. 2).

The no-load space 27 of the function carrier insert 23 is designed with perforations according to FIG. 3 and has several openings 46 through which the no-load space 27 is connected to an interior space 47 of filter housing 2 which is enclosed by filter housing 2.

A pressure regulating valve 48 is arranged on the rear side of function carrier insert 23 facing the interior 47 of filter housing 2. The position of this pressure regulating valve 48 is shown in FIG. 2 without including the function carrier insert 23 for the sake of illustration. This pressure regulating valve 48 consists essentially of a cylindrical sleeve 49 which contains at least one radial opening 50. A control piston 51 (see FIG. 2) is mounted so that it is axially adjustable in the interior of sleeve 49. This control piston 51 is prestressed by a spring 52 against a piston seat 53 formed in the interior of the sleeve 49. The spring 52 is supported here on control piston 51 on the one hand and on a supporting disc 55 on the other hand which is held in the sleeve 49, e.g., by flanging. On the axial end containing piston seat 53, the sleeve 49 also has an axial opening 54.

In the assembled state, the pressure regulating valve 48 is secured on the function carrier insert 23, to which end this has retaining elements 56 on its rear side according to FIG. 4, surrounding the sleeve at least partially on its outside. The end of sleeve 49 containing the opening 54 is supported via a gasket 57 on a corresponding sealing face formed on the function carrier insert 23. The opposite end of sleeve 49 is supported on a corresponding seat 58 on filter housing 2 in the interior 47 of filter housing 2 in the assembled state.

The axial opening 54 communicates with outlet space 26, while the radial opening 50 controlled by the control piston 51 communicates with the no-load space 27 and/or with the interior 47 of filter housing 2. Since the interior 47 and the no-load space 27 communicate with one another through the openings 46, the pressure of the no-load space, i.e., regularly approximately atmospheric ambient pressure, prevails in these spaces 27, 47. In contrast with that, an elevated pressure namely approximately the delivery pressure of a pump (not shown here), e.g., an oil pump of a lubricant system prevails in the outlet space 26. The pressure-regulating valve 48 is sought so that the control piston 51 releases the radial opening 50 beyond an upper limiting pressure (control pressure) so that a corresponding pressure reduction can take place through the no-load space 27 and the interior 47. The arrangement of this pressure-regulating valve 48 in the outlet space 26 has the advantage that the fluid pressure supplied to the component is regulated, thus reducing the risk of damage to the component due to an incorrect fluid pressure.

According to FIG. 7, a cylindrical pipe union 59 which communicates with the cold side of heat exchanger 17 is provided in the interior of filter housing 2. In the interior of this pipe union 59 is formed a seat 60 which is open on one side and on which is supported a disk which is designed as a separable component and is labeled as 61 in FIG. 9 and has an inside thread which cooperates with an outside thread on the central screw 18 of heat exchanger 17. The heat exchanger 17 can be screwed onto filter housing 2 in this way without having to provide a thread on filter housing 2.

According to FIG. 8, the third flange 16 is also designed to be essentially cylindrical or circular in shape and is sealed with respect to the heat exchanger 17 by means of a corresponding gasket 62 which acts axially, shown here only with broken lines. This gasket 62 encompasses the end of the feeder channel 45 provided for the third flange 16, the end being arranged on the outside radially with respect to a center of the third flange 16. This feeder channel 45 communicates with an entrance of the heat exchanger 17 that is arranged on the outside radially (not shown here), i.e., it communicates with the hot side of the heat exchanger. The end of the pipe union 59, which is provided for the third flange 16 and communicates there with an outlet of the heat exchanger 17 (not shown here), i.e., with its cold side, is arranged centrally with respect to the third flange 16. In another embodiment, guide means, e.g., ribs are provided on the filter housing 2 concentrically with the third flange 16, cooperating with the heat exchanger on assembly of heat exchanger 17 and thus centering it relative to the third flange 16.

According to FIG. 9, an axially projecting cylindrical feeder connection 63 is formed on the lower side of the filter chamber shoulder 5 which faces away from the cover 6, this feeder connection cooperating with the pipe union 59 (shown in FIG. 7) of the filter housing 2 in the manner of a plug connection. A gasket 64 which acts radially is provided on the feeder connection 63, sealing this plug connection. Adjacent to feeder connection 63 the outlet connection 42 which projects essentially radially away from the filter chamber shoulder 5 is provided on the lower side of the filter chamber shoulder 5 (see FIG. 2). This outlet connection 42 works together with a pipe union 65 formed on the rear side of the function carrier insert 23 and assigned to the outlet chamber 26 in the manner of a plug connection. It is clear that corresponding sealing means which act radially are also provided here. The pipe union 65 of the outlet chamber 26 opens into the outlet chamber 26 through the outlet opening 40 (see FIG. 3).

In addition, a pipe coupling 66 which is also cylindrical in shape and extends parallel to pipe union 65 of the outlet chamber 26 is provided for the feeder space 25 on the rear side of function carrier insert 23. This pipe coupling 66 works together with a pipe union 67, which is designed on one end of the feeder channel 45 and is formed in the interior of filter housing 2, in the manner of a plug connection. Pipe coupling 66 also has a gasket 68 which acts radially. A non-return valve 69 is provided in the interior of pipe coupling 66 and permits flow only from pipe coupling 66 into pipe union 67 while blocking any return flow. Pipe coupling 66 opens through feeder opening 44 into feeder space 25.

On the rear side of function carrier insert 23, an auxiliary connection 70, which is designed to be cylindrical, is formed, also facing the outlet space 26 and running parallel to the other connections 65 and 66. This auxiliary connection 70 also has a radial gasket 71 and cooperates with an auxiliary connection 72 formed on the end of the auxiliary channel 43 in the manner of a plug connection. The auxiliary connection 70 opens into the outlet space 26 through opening 41.

Due to the parallel design of connections 65, 66 and 70 as well as their design as plug connector elements, it is especially simple to assemble function carrier insert 23.

Fluid flow through liquid filter 1 functions as follows:

Heated and contaminated liquid penetrates into feeder space 25, coming from the feed of the component (FIG. 3). From feeder space 25 the liquid passes through pipe coupling 66 (FIG. 9) into feeder channel 45 (FIG. 2). From feeder channel 45 (FIG. 8) the liquid then enters the hot side of heat exchanger 17. In heat exchanger 17 the contaminated liquid on the crude side is cooled. The cooled liquid passes through the central outlet of heat exchanger 17 through pipe union 59 (FIG. 8) into the feeder connection 63 (FIG. 9) of the liquid chamber shoulder 5. In the interior of filter chamber shoulder 5, the contaminated liquid penetrates through the filter insert and thus reaches the clean side of filter housing 1. The liquid, which has now been cooled and cleaned, passes through outlet connection 42 (FIG. 9) into the outlet space 26 (FIG. 3) and goes from there to the outlet of the component. Through outlet space 26 the cooled cleaned liquid also enters the auxiliary channel 43, so that the liquid temperature and pressure can be detected by sensors 20 and 21 for example.

Thus the liquid is always sealed with respect to the interior space 47 of the filter housing 2. In the case of a leak in the interior of the filter housing 2, liquid on the crude side or on the clean side would always escape into the relatively pressureless interior space 47 which communicates through openings 46 with no-load space 27 and thus with the no-load space of the component.

This also yields in an especially simple manner the possibility of providing a no-load opening on the filter chamber shoulder 5 opening into the interior 47 so that it can be opened to remove the ring filter insert.

The design of liquid filter 1 according to this invention is selected so that a screw connection between metal parts is always possible when connections which must be sealed axially. In this way, the plastic components are exposed only to such loads that can be withstood by these materials with no problem. The connection provided for mounting the filter chamber shoulder 5 on the filter housing 2 by means of the second flange 4 need not withstand any high forces because the interior space 47 of the filter housing 2 is pressureless and because only relatively low forces act axially on the filter chamber shoulder 5 in the area of the plug connection between the feeder connection 63 and pipe union 59.

What is claimed is:

1. A liquid filter, in particular an oil filter for cleaning lubricant oil, in particular for internal combustion engines in motor vehicles, having the following features:

a ring filter insert is arranged in the interior of the liquid filter (1), where it separates a clean side from a crude side, the liquid filter (1) has a filter housing (2) made of metal, having a first flange (3) with which the liquid filter (1) is screwed onto a component by means of a screw connection, the component has a crude side feed for unclean liquid, an outlet for purified liquid and a relatively pressureless no-load space, the first flange (3) has an exterior gasket (24) which acts axially and encompasses the feed, the outlet and the no-load space, the first flange (3) contains a carrier receiving space (22) which is encompassed by the exterior gasket (24), a function carrier insert (23) defining a wall (32) is inserted into the carrier receiving space (22), the wall (32) surrounding a feeder space (25) which is open toward the feed, an outlet space (26) which is open toward the outlet and a no-load space (27) which is open toward the no-load space of the component, the individual spaces (25, 26, 27) being sealed with respect to one another by internal gaskets (28) which act axially, the screw connection with which the first flange (3) is screwed onto the component, acts axially and presses the axially acting gaskets (24, 28) axially onto the component, while the function carrier insert (23) is supported on the first flange (3).

2. The liquid filter according to claim 1, characterized in that the function carrier insert (23) is made of plastic.

3. The liquid filter according to claim 1, characterized in that the function carrier insert (23) has a non-return valve (69) by which the feeder space (25) is connected to the crude side of the liquid filter (1) such that a feeder flow from the feed to the crude side is open, but a return flow from the crude side to the feed is blocked.

4. The liquid filter according to claim 1, characterized in that the function carrier insert (23) has a pressure regulating valve (48) which connects the outlet space (26) to the no-load space (27) above a predetermined control pressure and/or to an interior space (47) of the filter housing (2) communicating with the no-load space.

5. The liquid filter according to claim 1, characterized in that the pressure-regulating valve (48) has a cylindrical sleeve (49) in which a control piston (51) is mounted so that it is axially adjustable; the sleeve (49) contains at least one radial opening (50) communicating with the no-load space (27) and/or with the interior space (47); the sleeve (49) is open on at least one axial end and communicates with the outlet space (26); spring means (52) prestress the control piston (51) toward this axial end; the control piston (51) blocks the at least one radial opening (50) as a function of its axial position relative to the sleeve (49) or opens it more or less.

6. The liquid filter according to claim 1, characterized in that the filter housing (2) has a second flange (4) with which a filter chamber shoulder (5) is mounted on the filter housing (2), whereby the filter chamber shoulder (5) contains the ring filter insert and is sealed with a cover (6) on a side facing away from the filter housing (2) and has in the interior of the filter housing (2) a crude-side feeder connection (63) and a clean-side outlet connection (42) on a side facing away from the cover (6).

7. The liquid filter according to claim 6, characterized in that the filter chamber shoulder (5) is made of plastic.

8. The liquid filter according to claim 6, characterized in that the feeder connection (63) of the filter chamber shoulder projects axially away from an axial end of the filter chamber shoulder (5), whereby a pipe union (59) that is formed in the filter housing (2) cooperates with the feeder connection (63) of the filter chamber shoulder (5) in the manner of a plug connection, and sealing means (64) that act radially are provided between the feeder connection (63) and pipe union (59).

9. The liquid filter according to claim 6, characterized in that the outlet connection (42) of the filter chamber shoulder (5) projects radially on an axial end of the filter chamber shoulder (5), a pipe union (65) being provided on the outlet space (26) of the function carrier insert (23), cooperating with the outlet connection (42) of the filter chamber shoulder (5) in the manner of a plug connection, and sealing means that act radially are provided between the outlet connection (42) and the pipe union (65).

10. The liquid filter according to claim 1, characterized in that the second flange (4) has a cylindrical wall (7) which projects axially away from the filter housing (2) and has axial projections (8) spaced a distance apart from one another by gaps (10) and having on their free axial ends elevations (9) which project outward radially;

radial projections (12) are formed on a cylindrical section (11) of the filter chamber shoulder (5) which cooperates with the second flange (4), each projection engaging in one of the gaps (10) and having elevations (13) that project outward radially on the side facing the filter housing (2);

a ring-shaped tension element (14) encompasses the second flange (4) in the area of the projections (8, 12), whereby the elevations (9) of the second flange (4) are located on a side of the tension element (14) which faces the filter chamber shoulder (5) and the elevations (13) of the filter chamber shoulder (5) are located on a side of the tension element (14) facing the filter housing (2) and are axially supported there.

11. The liquid filter according to claim 1, characterized in that the first flange (3) has a peripheral receiving groove (29) to accommodate the peripheral exterior gasket (24), this receiving groove (29) being designed so that a peripheral inner step (31) having an L-shaped cross section and being open toward the function carrier insert (23) is formed on a wall (30) of the first flange (3), and a peripheral outer step (33) having an L-shaped cross section and being open toward the wall (30) of the first flange (3) is provided on a wall (32) of the function carrier insert (23), whereby the outer step (33) and the inner step (31) supplement one another and are complementary to the receiving groove (29) when the function carrier insert (23) is inserted into the carrier receiving space (22).

12. The liquid filter according to claim 1, characterized in that the spaces (25, 26, 27) of the function carrier insert (23) are separated from one another by partitions (36) which have axially open grooves (35) on their ends which face the component, the interior gaskets (28) being inserted into these grooves, whereby at least one of the partitions (36) is designed as a double wall and has two essentially parallel individual walls (37) which are joined by a cross web (38) on their free ends, the groove (35) for the interior gasket (28) being formed on its front side facing the component, whereby in the area of the first flange on the filter housing (2) at least one rib is provided, engaging in the double wall and supporting the cross web (38) on its rear side facing away from the component.

13. The liquid filter according to claim 8, characterized in that the filter housing (2) has a third flange (16) with which the filter housing (2) is screwed onto a heat exchanger (17) , whereby an axially acting gasket is arranged between the heat exchanger (17) and the third flange (16), uncooled liquid from the component feed entering the heat exchanger (17) through a feeder in the heat exchanger (17) and flowing out of the heat exchanger (17) as a cooled liquid through an outlet of the heat exchanger (17) arranged in the interior of the feeder in the heat exchanger and flowing further to an ring filter insert.

14. The liquid filter according to claim 13, characterized in that the heat exchanger (17) is mounted on the filter housing (2) with a mounting component (18) which passes through the outlet, with a component (61) which has a thread and can be detached is supported on the filter housing (2).

15. The liquid filter according to claim 14, characterized in that the separable component (61) is supported in the interior of the pipe union (59) which cooperates with the feeder connection (63) of the filter chamber shoulder (5).

16. The liquid filter according to claim 13, characterized in that the feeder space (25) of the function carrier insert (23) has a pipe coupling (66) which projects axially somewhat away from the function carrier insert (23) on a side facing away from the component, whereby the filter housing (2) has a pipe union (67) which cooperates with this pipe coupling (66) in the manner of a plug connection and communicates with the feeder of the heat exchanger (17).

17. The liquid filter according to claim 1, characterized in that the outlet space (26) has an auxiliary connection (70) which projects slightly away from the function carrier insert (23) axially on a side facing away from the component, whereby the filter housing (2) has an auxiliary connection (72) which cooperates with this auxiliary connection (70) in the manner of a plug connection and communicates with at least one sensor (20, 21) mounted on the filter housing (2).

18. The liquid filter according to claim 1, characterized in that an interior space (47) of the filter housing (2) surrounded by the filter housing (2) has sealed elements carrying liquid on the clean side and on the crude side passing through it, whereby the no-load space (27) of the function carrier insert (23) communicates with this interior space (47) of the filter housing (2).

* * * * *